United States Patent [19]

Kim

[11] Patent Number: 4,833,661

[45] Date of Patent: May 23, 1989

[54] TIMEPIECE WITH RANDOM-NUMBERED DIAL

[76] Inventor: Sung-Du Kim, 269-9 Nonhyun-dong, Kangnam-ku, Seoul, Rep. of Korea

[21] Appl. No.: 244,690

[22] Filed: Sep. 15, 1988

[30] Foreign Application Priority Data

Sep. 17, 1987 [KR] Rep. of Korea ..... 1987-10328[U]

[51] Int. Cl.[4] ..... G04B 19/04

[52] U.S. Cl. ..... 368/80; 368/223; 368/228

[58] Field of Search ..... 368/76, 80, 220, 223–239

[56] References Cited

U.S. PATENT DOCUMENTS 4,659,232 4/1987 Coster et al. ..... 368/223

*Primary Examiner*—Vit W. Miska

*Attorney, Agent, or Firm*—Michael N. Meller

[57] ABSTRACT

A watch has a dial with numerals 1 through 12 circumferentially distributed thereon in a random sequence. The current time is indicated by the watch hands notwithstanding this random sequence of numerals, together with a digital display of the current time. The minute hand makes an abrupt large angular movement every five minutes to the relevant position indicating the minute of current time, while the hour hand makes an abrupt large movement for every hour to the relevant position indicating the hour of current time. When the minute hand reaches the position of numeral 12, the hour hand abruptly moves through a large angular distance to indicate the current hour. Drivers rotate the minute and watch hands in accordance with a predetermined stored program.

5 Claims, 4 Drawing Sheets

TIMEPIECE WITH RANDOM-NUMBERED DIAL

FIELD OF THE INVENTION

The present invention relates to a watch, clock or other timepiece in which the numerals on the dial are randomly arranged and the hands indicate the correct time notwithstanding.

BACKGROUND OF THE INVENTION

In ordinary conventional clocks and watches, the numerals consisting of 1 through 12 are arranged on the dial sequentially, and therefore, under some special views, they are monotonous and incapable of arousing the curiosity of the people of the present age.

SUMMARY OF THE INVENTION

It is the object of the present invention to provide a watch, clock or other timepiece which can overcome the monotony of conventional watches and clocks, and arouse fresh interest in people by randomly arranging the numerals on the dial, making the hands indicate the correct time notwithstanding.

Owing to the programs stored therein, the timepiece of the present invention can show the correct time by abruptly moving the hands across the randomly arranged numerals. This function caters to the psychological trends among people of the present age, who incessantly seek some change in the routine of their lives. Therefore the device of the present invention can arouse the interest of and delight people, whereas for children, it can improve their thinking power, and can stimulate their curiosity for research and study. Further, the device of the present invention can attract the attention of shoppers when it is displayed at or near an exhibition booth.

DESCRIPTION OF THE PREFERRED EMBODIMENT

The above object and other advantages of the present invention will become more apparent from the detailed description of the preferred embodiment of the present invention with reference to the drawings.

On a dial 1, numerals 1 through 12 are circumferentially distributed at regular intervals in a random arrangement along a circle, and hands 2, 3 and 4 for respectively indicating the hour, minute and second are connected to stepping (pulse) motors $M_1$, $M_2$, $M_3$. The correct time indicated by the digital display sections OP, MP, SP, indicating the hour, minute and second respectively, is also correspondingly indicated by the individual hands 2, 3, 4, which are rotatable clockwise and counterclockwise.

Figure 5:
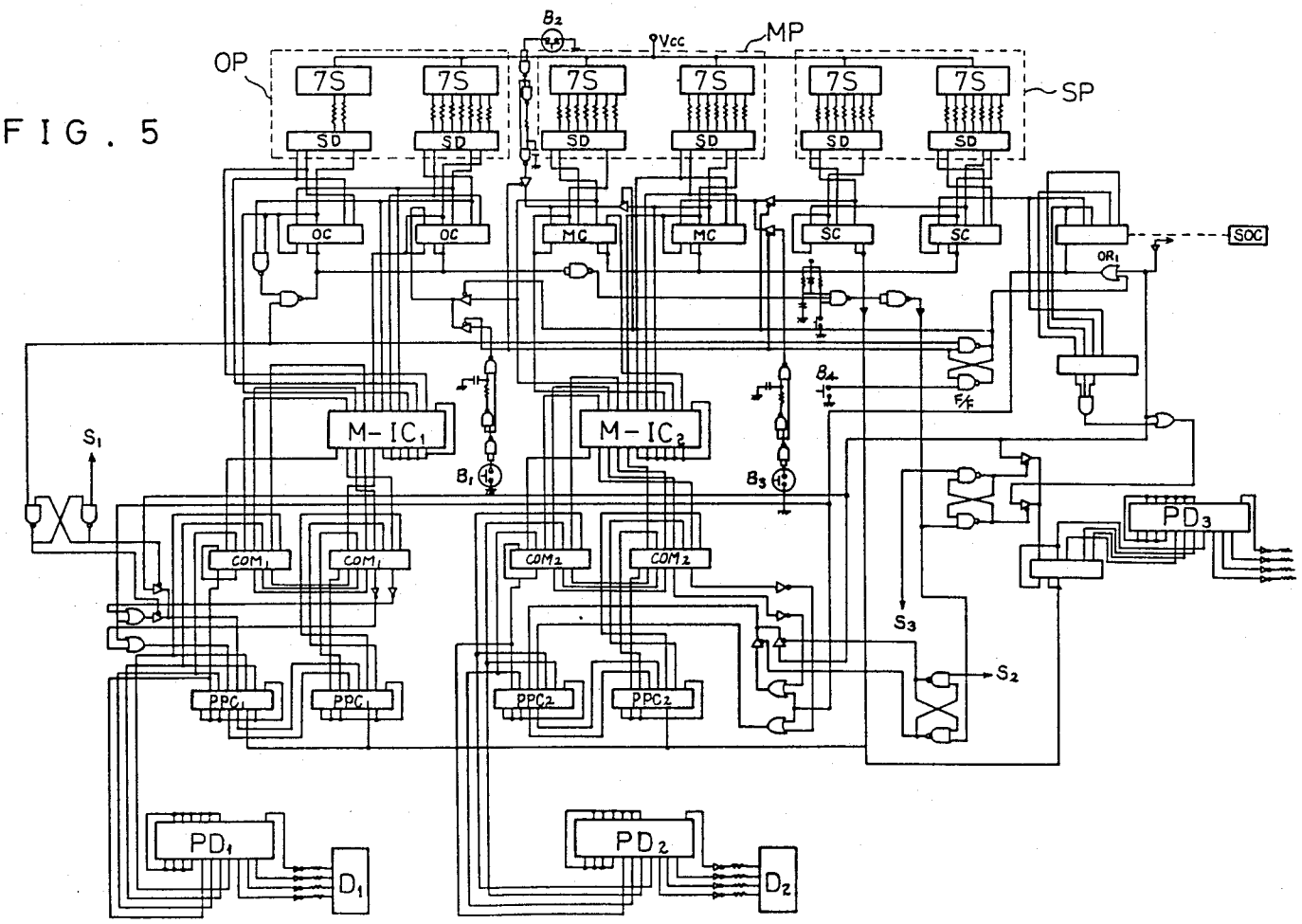
FIG. 5 is a more detailed illustration of the circuitry generally depicted in FIG. 4.

Counters OC, MC, SC, for counting the hour, minute and second respectively are connected respectively to the digital display sections OP, MP, SP, which are in turn connected to a quartz oscillator OSC through on OR gate $OR_1$. The other input terminal of OR gate $OR_1$ is connected to a start button $B_4$ by way of flip-flop F/F. The counters OC, MC for counting the hour and minute are respectively connected to memory integrated circuits M-IC1 and M-IC2, which are in turn respectively connected to comparators $COM_1$, $COM_2$, which are respectively connected to add command control pins $P_1$, $P'_1$ and to subtract command control pins $P_2$, $P'_2$. The command control pins $P_1$ and $P_2$ control the incrementing and decrementing of the count in the counters. Counters OC, MC are thus respectively connected to present position counters $PPC_1$, $PPC_2$. The present position counters $PPC_1$ and $PPC_2$ and the counter SC for counting the second are respectively connected to pulse distributors $PD_1$, $PD_2$, $PD_3$, which are in turn respectively connected to drivers $D_1$, $D_2$, $D_3$. Drivers $D_1$, $D_2$, $D_3$ are respectively connected to drive stepping (pulse) motors $M_1$, $M_2$, $M_3$. In FIG. 5 the reference symbol 7S indicates a 7-segment LED and SD indicates a 7-segment driver. $S_1$, $S_2$ and $S_3$ are the stop sensors for the stepping motors $M_1$, $M_2$, $M_3$ respectively.

Now, the function and result of the device of the present invention having the foregoing structure will be described.

Figure 1:
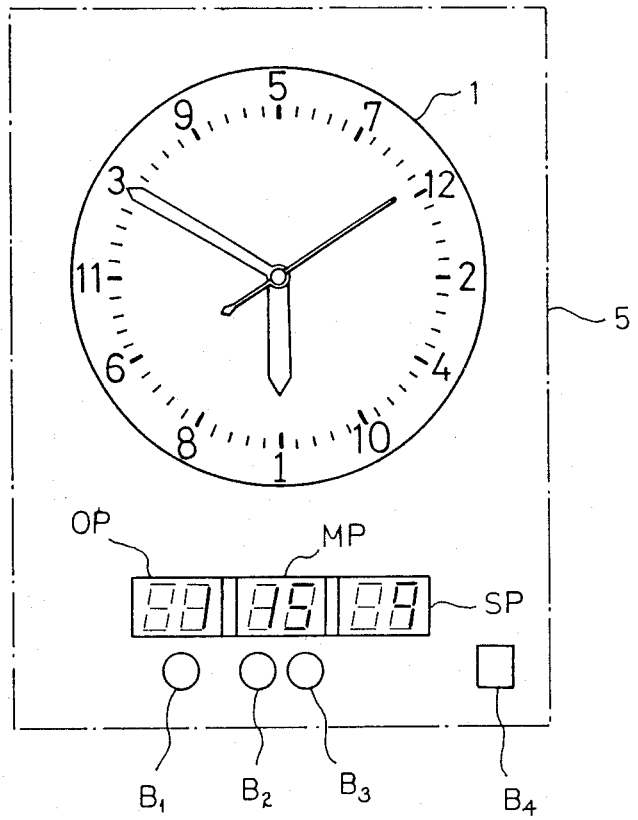
FIG. 1 is an exemplary illustration of the device according to the present invention showing the random arrangement of the numerals on the dial.

When the watch as shown in FIG. 1 is working, if the power source is disconnected and the current is stopped, then the digital display sections OP, MP, SP for displaying the hour, minute and second will lose their illumination, and the hands 2, 3 and 4 will stop at their present positions. If the power source is applied again, the quartz oscillator OSC will generate pulses on the order of megahertz, and these pulses will pass through a frequency divider (not shown), where the frequency of the output pulses will be decreased.

If the frequency of the pulses is reduced to the range of 10 to 50 Hz (a period of 0.1 to 0.05 second), then the pulses will be cleaved and outputted by respective pulse distributors $PD_1$, $PD_2$, $PD_3$.

By means of these output pulses, the stepping motors $M_1$, $M_2$, $M_3$, which are respectively connected to the hands 2, 3, 4, are activated in order to move the hands abruptly to the respective pertinent positions. More exactly, the moving hands 2, 3, 4 are stopped at the respective exact positions by the actions of the stop sensors $S_1$, $S_2$, $S_3$ which are respectively connected to the stepping motors $M_1$, $M_2$, $M_3$.

The pulse distributors $PD_1$, $PD_2$ and $PD_3$ receive pulses of 10–50 Hz (0.1–0.05) second from oscillator OSC through terminal "a" to operate the stepping motors, thus moving the watch hands by the rotation speed of a dial second mark every 0.1–0.05 second. Pulse distributor $PD_3$is simply operative to receive single pulses of 1 Hz so as to operate the second hand. Pulse distributor $PD_1$ is operative to receive an add or subtract command signal from the comparator which resulted from the difference between the stored numbers in the memory IC and the current values in the present position counter so as to operate the hour hand (the present position counter is renewed by the signal from the comparator). $PD_2$ is operative to receive an add or subtract command signal from the comparator which resulted from the difference between the stored numbers in the memory IC and the current values in the present position counter so as to operate the minute hand (the present position counter is renewed by the signal from the comparator).

From the foregoing, it is understood that $PD_3$ simply receives single pulses of 1 Hz from the $OR_1$ whereas, the repsective comparison singal is transmitted from the combined circuit of M-IC, COM and PPC to $PD_1$ and $PD_2$.

In operation, first the buttons $B_1$, $B_2$, $B_3$ for setting the hour, minute and second are manipulated to adjust the digital display, and then the start button $B_4$ is pressed (in FIG. 1, the time is a quarter past one o'clock.) Upon pressing of the button $B_4$, pulses are generated from the quartz oscillator OSC, and these pulses are frequency divided. Singular pulses of 1 Hz are produced from the frequency dividing process and applied through the OR gate $OR_1$ to the digital display section SP for displaying the second. At the same time, the pulses are also applied to the counter SC for counting the second and to the pulse distributor $PD_3$ in order to drive the stepping motor $M_3$ by means of the driver $D_3$, so that the second hand 4 should rotate at intervals of one second. Meanwhile, the values of the digital display section MP for displaying the minute and digital display section OP for displaying the hour are supplied to the counter MC for counting the minute and to the counter OC for counting the hour to designate the addresses to be read from the associated memory integrated circuits M-IC1, M-IC2. In response, the data stored at these addresses are output.

The data stored in the respective addresses of the memory M-IC1 are numerals 1–12 corresponding to the desired position of the hour hand 2 for each of the positions from one to twelve o'clock according to the stored program, whereas the data stored in the respective addresses of the memory M-IC2 are numerals 1–60 corresponding to the desired position of the minute hand 3 for each of the 60 minutes in an hour.

Figure 2:
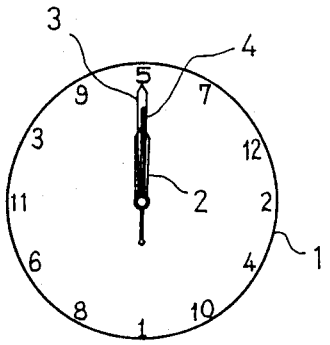
FIG. 2 illustrates the case where all the hands are located at the same radial position in overlapping relationship, i.e. at numeral 5.
Figure 3:
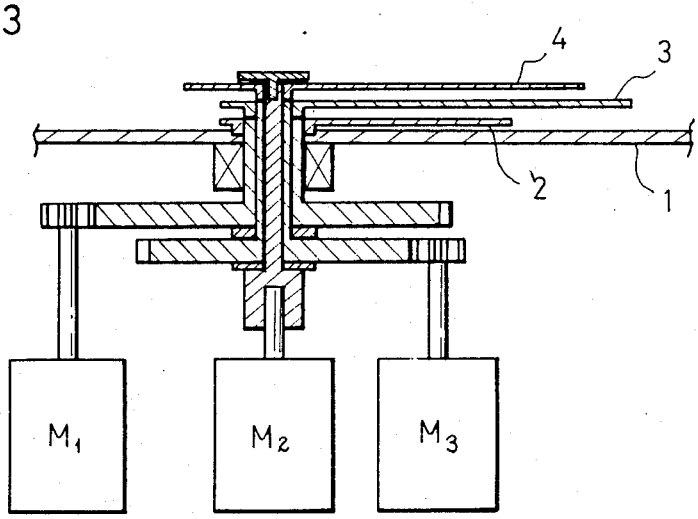
FIG. 3 is a schematic cross sectional view showing the individual hands respectively connected to stepping motors for driving thereof.
Figure 4:
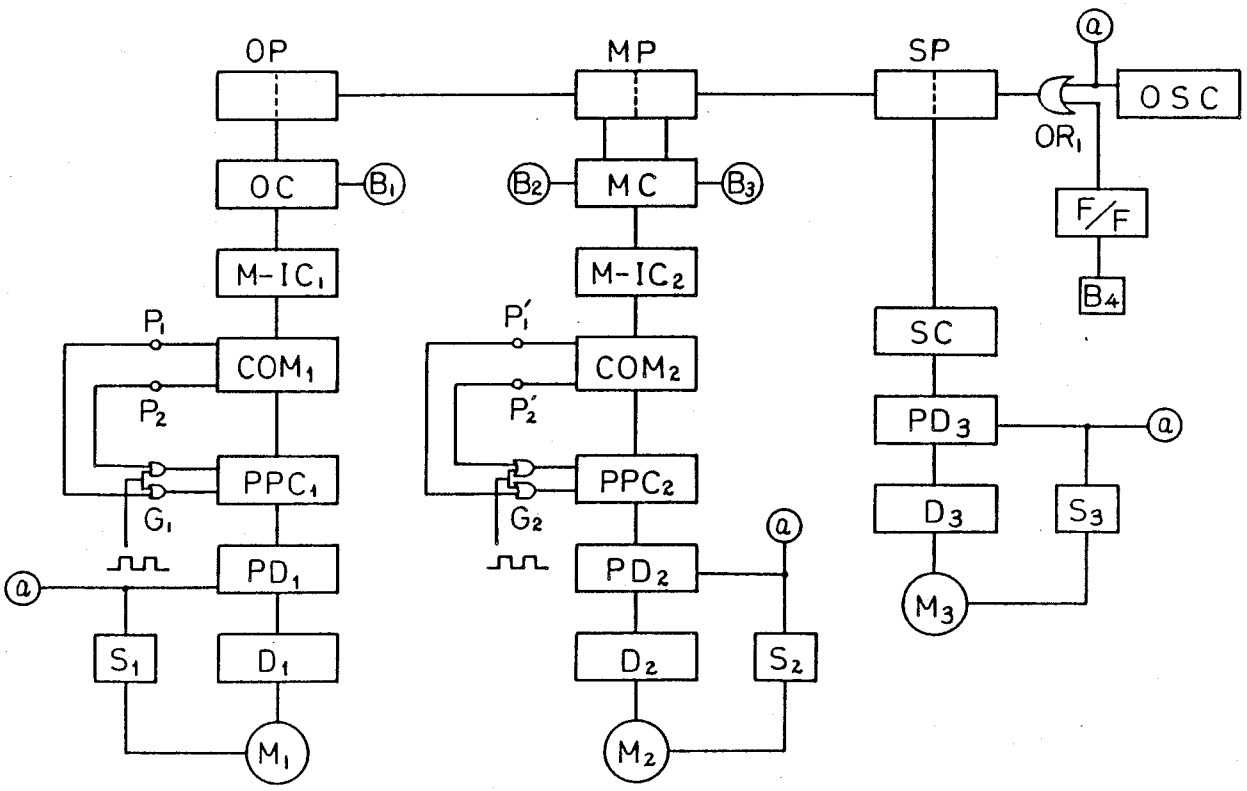
FIG. 4 is a circuit block diagram of the device according to the present invention.

First, the shifting of the hour hand 2 will be described. As shown in FIG. 2, the watch hands on the dial 1 all rest initially at numeral 5, which occupies the position of numeral 12 (or 0) in the conventional dial. The comparator COM1 compares the value stored at the designated address of the memory M-IC1 and the value held by the present position counter PPC1. If, for example, the address 1 of the memory IC (M-IC1) is designated by the corresponding time signal 1 as shown in the digital display section OP and the address 1 has the value 6 stored thereat with the value in the present position counter $PPC_1$ being zero, then the add command control pin $P_1$ is operated to increment the present position counter $PPC_1$ to the stored value 6. At the same time, the pulse distributor $PD_1$ is operated to drive the stepping motor $M_1$ and consequently to rotate the hour hand 2 clockwise. The value held by the present position counter $PPC_1$, which is incremented by unity, is continuously compared with the value stored in the designated address of the memory M-IC1, and thus, if the above two values become equal (6:6), the hour hand 2 at that time will stop at the position of the numeral 1. At this time, when the above values become equal, the gate $G_1$ which is connected to the add command control pin $P_1$is automatically switched off. That is, the digital time signal 1 designates the corresponding address 1 to move the time hand to "6", which was stored previously at address 1 and also represents the position of the conventional dial numeral 6 having "1" numbered thereon according to the present invention.

The relationship of the digital time or address with respect to the conventional dial numeral or the stored value at the address is arbitrary.

The relationships between the numbers in the memory and the actual time in accordance with the preferred embodiment are tabulated as follows:

| | | | | | | | | | | | | |
|---|---|---|---|---|---|---|---|---|---|---|---|---|
| | | | | | memory M-IC1 | | | | | | | |
| P | 1 | 2 | 3 | 4 | 5 | 6 | 7 | 8 | 9 | 10 | 11 | 12 |
| C | 6 | 3 | 10 | 4 | 12 | 8 | 1 | 7 | 11 | 5 | 9 | 2 |
| | | | | | memory M-IC2 | | | | | | | |
| P | 5 | 10 | 15 | 20 | 25 | 30 | 35 | 40 | 45 | 50 | 55 | 60 |
| C | 30 | 15 | 50 | 20 | 60 | 40 | 5 | 35 | 55 | 25 | 45 | 10 |

where P is the present dial numerals or addresses, and C is the conventional dial numerals as in the corresponding dial positions or the stored numbers.

Similarly, in the case of the minute hand 3, the value (say 5) stored at the designated address (say 15) of the memory M-IC2 is compared with the value (zero at present) of the present position counter $PPC_2$. Since, at present, the value of the present position counter $PPC_2$ is smaller than the value stored in the memory M-IC2, the add command control pin $P'_1$ is operated to increment the present position counter $PPC_2$ repeatedly. At the same time, the pulse distributor $PD_2$ is operated to drive the stepping motor $M_2$ and thereby to rotate the minute hand 3 clockwise. At the time when the value from the memory M-IC2 and the value in the present position counter $PPC_2$become equal (for example, 50:50), the gate $G_2$ connected to the add command control pin $P'_1$ is switched off, and the minute hand 3 is stopped at the position of numeral 3, indicating 15 minutes.

To continue the description about further operation, the counter MC for counting the minute keeps counting in accordance with the varying value of the digital display section MP for displaying the minute in order to designate the corresponding address of the memory M-IC2, while the comparator $COM_2$ compares the value stored in the designated address of the memory M-IC2 with the value of the present position counter $PPC_2$. If the value of the memory M-IC2 is greater than the value of the present position counter $PPC_2$, the add command control pin $P'_1$is operated to rotate the minute hand 3 clockwise. On the contrary, if the value of the present position counter $PPC_2$ is greater than the value stored in the designated address of memory M-IC2, the subtract command control pin $P'_2$ is operated to rotate the minute hand 3 in the opposite direction while decrementing the value of the present position counter $PPC_2$ repeatedly. The abrupt movements of the minute hand occur once for every five minutes. That is, in the time interval between 15 minutes and 19 minutes, the minute hand rotates an angle of 6° for each minute, but when the time point of 20 minutes is reached, the minute hand 3 makes a large angular displacement (i.e. 180°) to exactly stop at the position of numeral 4.

This abrupt large swing of the minute hand 3 occurs by the following process. When the time point of 20 minutes is reached, the comparator $COM_2$ compares the value of the present position counter $PPC_2$ with the value stored at the designated address in M-IC2. Depending on which value is greater, the add command control pin $P'_1$ or the subtract command control pin $P'_2$ is operated to rotate the minute hand 3 clockwise or counterclockwise and to set the minute hand 3 at the exact position of numeral 4 on the dial 1. Thereafter the minute hand 3 rotates an angle of 6° every minute and reaches the position right before numeral 10. Then the minute hand 3 makes an abrupt large angular displacement to the position of numeral 5 (i.e. 120°). If the minute hand 3 advances to the position right before numeral 7, then the minute hand 3 again makes an abrupt large angular displacement (i.e. 120°) to the positon of numeral 6. Upon reaching the position right before numeral 11, the minute hand 3 again makes an abrupt large angular displacement (i.e. 150°) to the position of numeral 7.

Meanwhile the hour hand 2 makes abrupt large angular displacements at hourly intervals in a similar manner. Assuming that the watch hands 2 and 3 indicate the time 1:59 and one minute has passed thereafter, the comparator $COM_1$ compares the value of the present position counter $PPC_1$ with the value of the designated address in memory to turn the hour hand 2 clockwise or counterclockwise depending on which value is greater until the hour hand 2 is stopped at the position of numeral 2 on the dial 1. When the minute hand 3 again rotates from the position right before 60 minutes, that is, the position of 59 minutes, the hour hand 2 makes an abrupt large angular displacement (i.e. 150°) to the position of numeral 3.

As described above, the dial 1 according to the present invention is provided with a random arrangement of numerals (1 through 12) and with watch hands 2, 3, 4 for the hour, minute and second respectively which are coupled to the digital sections of the watch. The hour hand 2 makes abrupt large angular displacements at intervals of one hour to indicate the current time, while the minute hand 3 makes abrupt large angular displacements once every five minutes to indicate the current time. Therefore the timepiece according to the present invention is entirely free of the monotony of conventional timepieces, uses a novel method for indicating the time, and creates a new conception about timepieces which satisfies the curiosity of people. Further, the timepiece according to the present invention functions as an educational aid by arousing the interest of and stimulating the thinking power in children in order to ultimately upgrade the intelligence of children.

Further, if the timepiece of the present invention is displayed in an exhibition booth, it can attract the attention of passersby, thereby performing one function of a salesman.

It should be understood that various changes and modifications can be made to the device of the present invention without departing from the scope of the attached claims. Such changes and modifications would be obvious to one of ordinary skill in the art.

What is claimed is:

1. A timepiece comprising a dial having numerals 1 through 12 circumferentially distributed thereon in a random sequence, first and second members mounted for rotation relative to said dial; and driving means coupled to said first and second members for driving said first and second members to rotate in accordance with a predetermined program whereby the positions of said first and second members, when stationary, relative to said randomly arranged numbers on said dial respectively indicate the hour and minute of current time.

2. The timepiece as defined in claim 1, wherein said driving means comprises first and second stepping motors respectively to said first and second members.

3. The timepiece as defined in claim 2, further comprising a third member rotatably mounted for rotation relative to said dial, said driving means further comprising a third stepping motor coupled to said third member for driving said third member to rotate whereby the instantaneous position of said third member relative to said dial indicates the second of current time.

4. The timepiece as defined in claim 2, further comprising controls means for controlling said stepping motors in accordance with said predetermined program, said control means in turn comprising oscillator means for generating a pulsed signal, memory means for storing said predetermined program, means for distributing the pulses of said pulsed signal from said oscillator means, means for storing a count of pulses distributed by said distributing means, and means for comparing said stored count in said storing means with a selected one of a plurality angular position data stored in said memory means.

5. A timepiece comprising means for supplying digital signals representing real time, a dial having numerals 1 through 12 circumferentially distributed thereon in a random sequence, first and second members mounted for rotation relative to said dial, means for driving said first and second members to rotate, and means for controlling said driving means in accordance with a predetermined program.

* * * * *